US008210892B2

(12) United States Patent
Thrush et al.

(10) Patent No.: US 8,210,892 B2
(45) Date of Patent: Jul. 3, 2012

(54) MULTIPURPOSE FOAM FLOORING

(75) Inventors: Bruce Thrush, San Juan Capistrano, CA (US); Peter Szucs, Burbank, CA (US)

(73) Assignee: Parallax Group International, Inc., San Juan Capistrano, CA (US)

( * ) Notice: Subject to any disclaimer, the term of this patent is extended or adjusted under 35 U.S.C. 154(b) by 226 days.

(21) Appl. No.: 12/695,886

(22) Filed: Jan. 28, 2010

(65) Prior Publication Data

US 2010/0194039 A1 Aug. 5, 2010

Related U.S. Application Data

(60) Provisional application No. 61/148,009, filed on Jan. 28, 2009.

(51) Int. Cl.
*A63H 33/08* (2006.01)
*A63H 33/04* (2006.01)

(52) U.S. Cl. ..... 446/108; 446/120; 446/92; 446/97

(58) Field of Classification Search ..... 446/97, 446/99–101, 108, 109, 110, 120, 121; 273/154, 273/153, 157 RR
See application file for complete search history.

(56) References Cited

U.S. PATENT DOCUMENTS

| | | | | |
|---|---|---|---|---|
| 1,229,580 | A * | 6/1917 | Brown | 273/157 R |
| 2,731,766 | A | 1/1956 | Rubin | |
| 2,952,462 | A | 9/1960 | Planin | |
| 2,953,380 | A * | 9/1960 | Hassenbach | 273/157 |
| 4,287,693 | A | 9/1981 | Collette | |
| 4,570,936 | A | 2/1986 | Meiser et al. | |
| 5,212,842 | A | 5/1993 | Glydon | |
| 5,389,033 | A | 2/1995 | Rauch | |
| 5,448,868 | A | 9/1995 | Lalvani | |
| 5,536,009 | A | 7/1996 | Edwards | |
| 5,681,041 | A | 10/1997 | Coon | |
| 6,234,858 | B1 | 5/2001 | Nix | |
| 6,416,054 | B1 | 7/2002 | Alfassi | |
| 6,443,794 | B2 | 9/2002 | Oren et al. | |
| 6,526,705 | B1 | 3/2003 | MacDonald | |
| 6,554,677 | B2 | 4/2003 | Leemon | |
| 6,761,563 | B1 * | 7/2004 | Lin | 434/169 |
| D603,640 | S | 11/2009 | Thrush | |

(Continued)

FOREIGN PATENT DOCUMENTS

CN 2907792 6/2007

(Continued)

OTHER PUBLICATIONS

Zing, Foam Town USA—Foam Sweet Foam, http://www.amazon.com/Foam-Town-USA-Sweet-Home/dp/B0009X0972/ref=sr_1_?ie=UTF8&s=home-garden&qid=1280789229&sr=8-1.

(Continued)

*Primary Examiner* — Kien Nguyen

(57) ABSTRACT

A transformative floor mat system that is interactive as a toy and a mat that is safe, fun and creative. In one form, the floor mat has tiles with interlocking structure around the edges of each tile to prove for a secured large surface area. The floor mat also has play pieces that can be removed from within each tiles so that each tile can be connected to one another to form a play figure. The floor mat system could also be configured to form other three-dimensional structures and environments, such as castles, forests, and beaches.

20 Claims, 10 Drawing Sheets

U.S. PATENT DOCUMENTS

| | | | |
|---|---|---|---|
| D604,082 | S | 11/2009 | Thrush |
| D604,083 | S | 11/2009 | Thrush |
| 2005/0048871 | A1 | 3/2005 | Brown |
| 2006/0127647 | A1 | 6/2006 | Thrush |
| 2007/0199257 | A1 | 8/2007 | Thrush et al. |
| 2008/0124509 | A1 | 5/2008 | Boise |
| 2008/0303212 | A1 | 12/2008 | Lai et al. |
| 2009/0102178 | A1 | 4/2009 | Thompson |

FOREIGN PATENT DOCUMENTS

| | | |
|---|---|---|
| CN | 2907793 | 6/2007 |
| GB | 2227419 | 8/1990 |
| NL | 2002217 | 9/2009 |
| WO | 9406528 | 3/1994 |
| WO | 9415688 | 7/1994 |
| WO | 2006113503 | 10/2006 |
| WO | 2007042825 | 4/2007 |
| WO | 2009016421 | 2/2009 |
| WO | 2008127980 | 10/2009 |

OTHER PUBLICATIONS

Able Data, Textured Number Floor Puzzle (Model A9246-30), Sammoms Preston, Bolingbrook, Illinois, http://www.abledata.com/abledata.cfm?pageid=113583&top=0&productid=76561&trail=0.

Wrebbit-"Puzz 3D" 3 Dimensional Foam Jigsaw Puzzles, 1997-2009 Jigsaw Jungle, http://www.jigsawjungle.com/code/wrebbit.htm.

* cited by examiner

FIG. 1
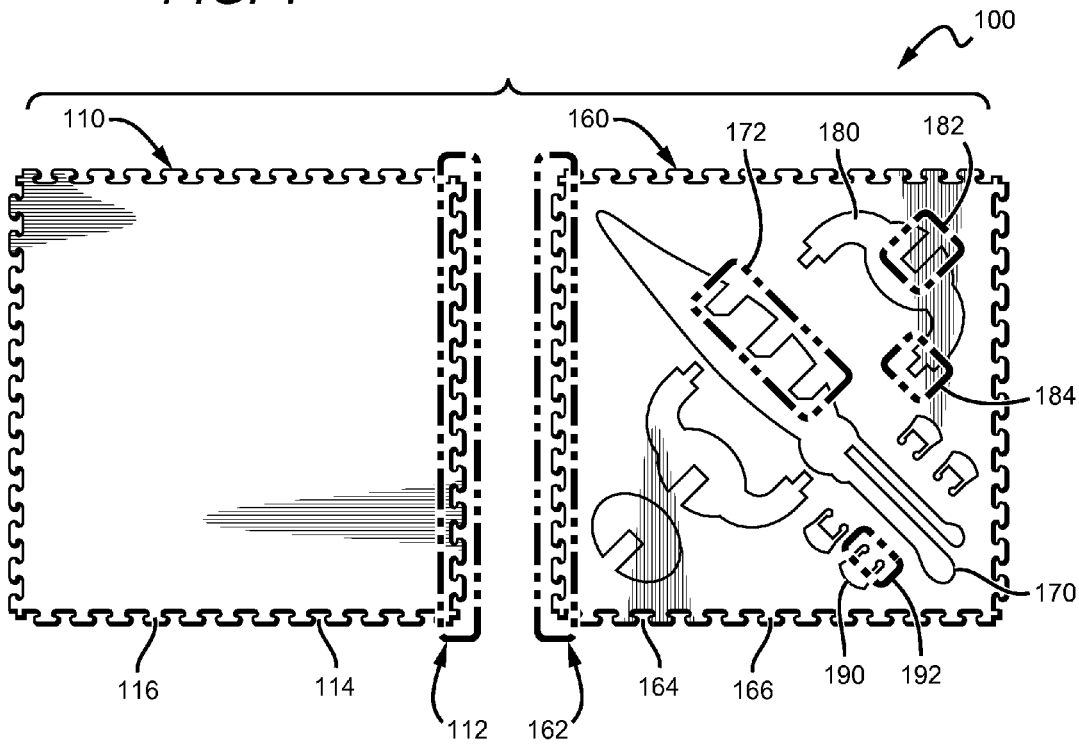
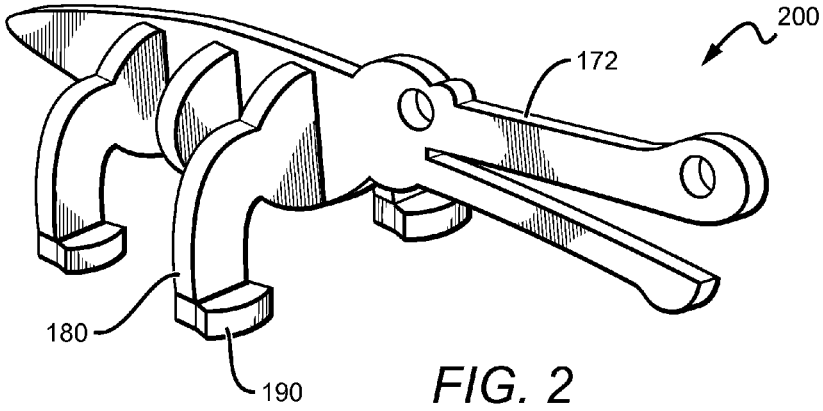
FIG. 2

FIG. 3
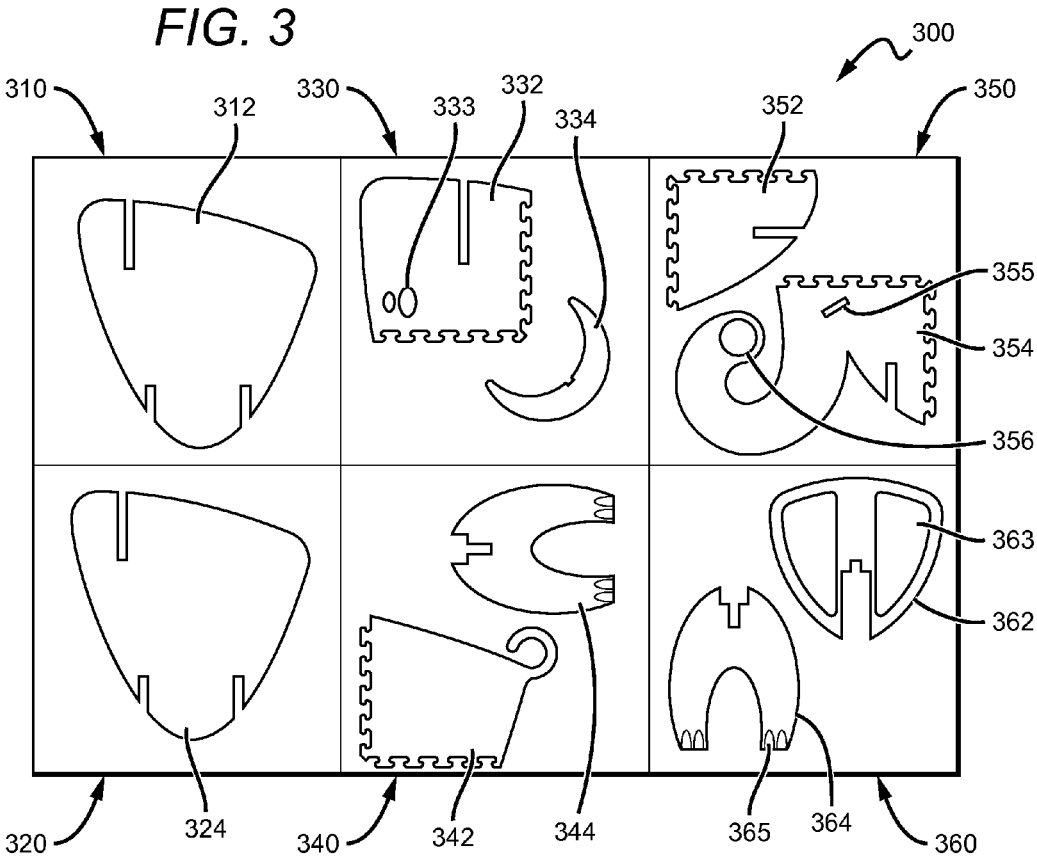
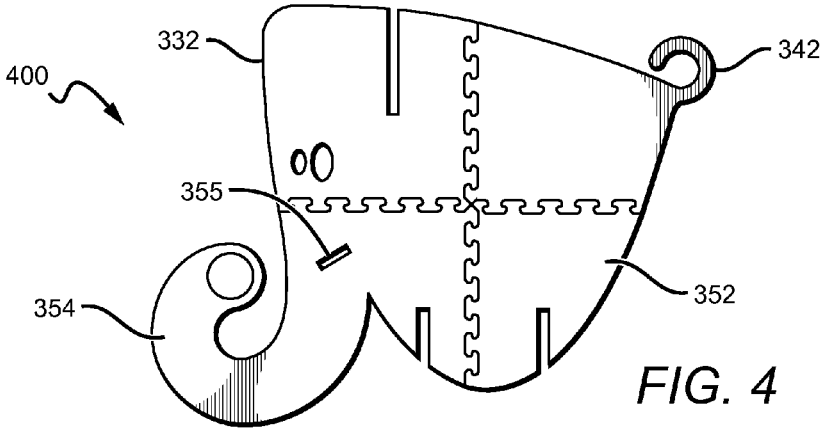
FIG. 4

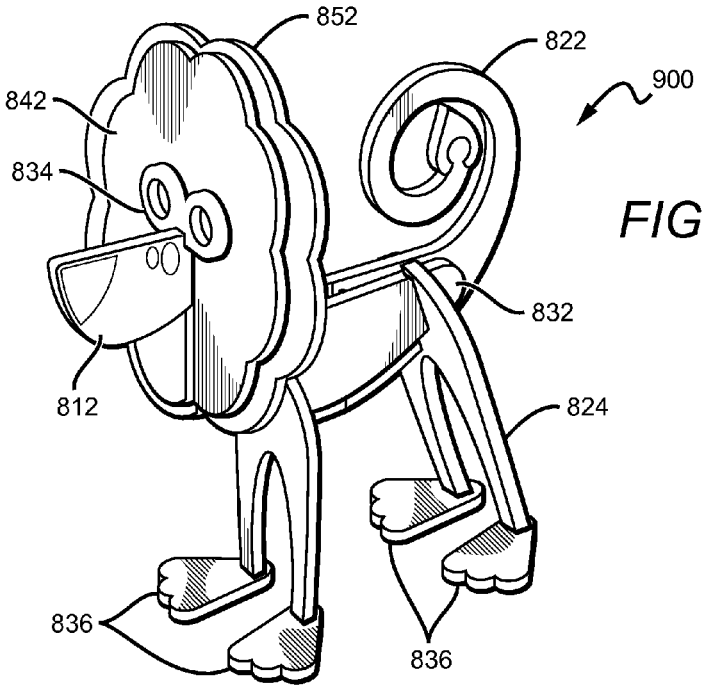
FIG. 10
FIG. 12
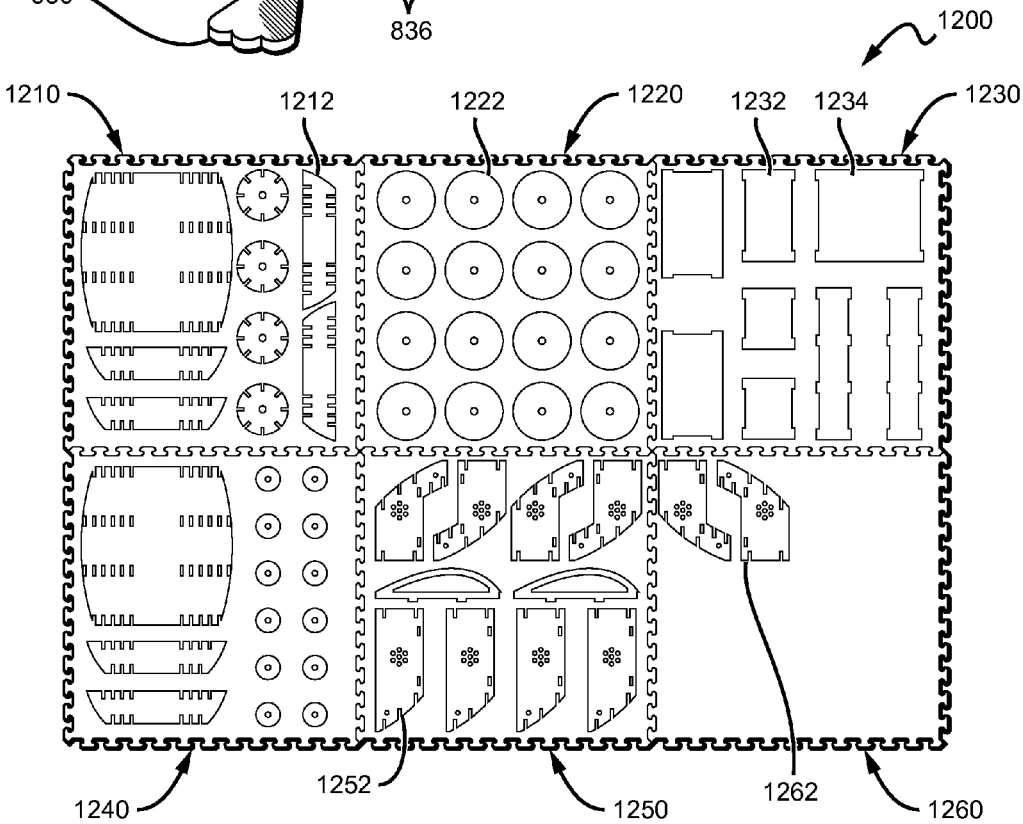

MULTIPURPOSE FOAM FLOORING

This application claims priority to U.S. provisional application Ser. No. 61/148,009 filed Jan. 28, 2009 which is incorporated herein by reference in its entirety.

FIELD OF THE INVENTION

The field of the invention is floor mats.

BACKGROUND

Playmats provide a useful and safe way to enjoy various activities. Caregivers to children in particular like soft foam playmats because they are comfortable and provide ample cushioning. Factors that influence someone to purchase a particular set of mats may include the costs; the packaging; the appearance of the mats; the quality of the mats and the assembly of these mats. Today most soft foam playmates on the market are quite similar in terms of these factors. Additional characteristic of the mats would provide a more attractive incentive for consumer to purchase.

Most mats are sold in a package of four or six individual solid pieces. Once out of the packaging, the individual pieces are connected to one another to secure a large covering area. The solid pieces maybe of one single color or reversible colors on each side. However, most of these mats function as nothing more than just mats. There is no interactive play with the mats. While some mats have various graphic illustrations on their surfaces and some even have cutouts such as letters and numbers within the mat pieces, none of these mats provide for constructive play.

U.S. Pat. No. 5,212,842 to Glydon teaches a padded matting product that can be (1) configured to form a foam floor mat to reduce injuries to children when they fall, (2) taken apart to form stacked tiles to allow for easy storage, and (3) be reconstructed to form padded blocks for children to play with. However, Glydon's structures are largely limited to blocks due to its limited geometry and coupling mechanisms, and fail to stimulate a variety of different games and playtime activities for children. Glydon and all other extrinsic materials discussed herein are incorporated by reference in their entirety. Where a definition or use of a term in an incorporated reference is inconsistent or contrary to the definition of that term provided herein, the definition of that term provided herein applies and the definition of that term in the reference does not apply.

WO2008/127980 to Kuzmin teaches a different padded matting product that could be (1) configured to form a foam floor mat, and (2) configured to form three-dimensional structures. Kuzmin, however, also fails to teach methods of providing more complex building blocks other than simple three-dimensional structures.

Thus, there is still a need for multipurpose padded products.

SUMMARY OF THE INVENTION

The inventive subject matter provides apparatus, systems and methods in which a transformative floor mat is configured to provide a variety of useful and imaginative activities for a user. The transformative floor mat generally has two or more panels that are configured to mate planarly with one another, and two or more play pieces that are configured to mate planarly with one or more of the panels. As used herein, objects that are configured to "mate planarly" with one another connect in such a way that the heights of the two connected edges are substantially equal to one another. In other words, the two objects connect to form a substantially contiguous plane. Measurements that are "substantially equal" to one another, such as substantially equal heights, widths, lengths and thicknesses. In preferred embodiments, these measurements deviate at least 1 mm, preferably no more than 5 mm from one another.

Exemplary panel embodiments could also mate angularly with one another. In contrast to objects that are configured to mate planarly with one another, objects that are configured to "mate angularly" with one another form a junction to form an angled corner greater than 5 degrees. Panels may be configured to mate at a substantially 30 degree angle, 45 degree angle, 60 degree angle, 90 degree angle, 120 degree angle, 150 degree angle, and, of course, a substantially 180 degree angle. As used herein, an angle that is "substantially X degrees" is an angle that is within 10 degrees of X degrees, and is preferably within at least 5 degrees or within 2 degrees of X degrees.

In a preferred embodiment, the panels mate with one another along a connecting outer edge. The connecting edges of the panels generally have one or more interlocking structures. As used herein, "interlocking structures" are matching recesses and projections that receive one another. In a preferred embodiment, projections are molded to be slightly larger than the recess, especially since elastic or foam projections that compress to fit a smaller recess provides a tighter fit. Exemplary interlocking structures include dovetail joints, butt joints, matching tongues and grooves, matching indents and detents, matching mortises and tendons, and jigsaw-type edges. Preferred interlocking structures include rounded, mushroom-shaped projections and recesses, to prevent injury to children who may be using the panel as a floor mat. While panels may only have one, two, or three edges with matching interlocking structures, and may have different interlocking structures on each edge, the panels preferably all have the same or similar interlocking structure along their perimeter, allowing the edge of any panel to mate with the edge of any other panel.

In order to form a floor mat, the panels are preferably shaped into planar bodies with a substantially consistent thickness, although wavy, curved, or jagged panels are contemplated. While exemplary panels disclosed herein are generally rectangular or square shaped, other panel shapes are contemplated, for example triangles, trapezoids, and even hexagons. Irregular panels are also contemplated. Preferably, the panel is at least 1 cm thick, preferably 3 cm thick so that a child could easily grab it. The panel also generally has a long length, preferably greater than 15, 20, 25, or 30 inches (38.1, 50.8, 63.5, or 76.2 cm).

Unless a contrary intent is apparent from the context, all ranges recited herein are inclusive of their endpoints, and open-ended ranges should be interpreted to include only commercially practical values. In this instance, and where other upper limits are not expressly stated, the reader should infer a reasonable upper limit. In this instance, for example, a commercially reasonable upper limit for a panel length is about 200 inches for floor matting products. The panels are generally made of a compressible material, preferably polyurethane foam. Any suitable padded material could be used in place of foam, for example inflated cloth or rubber. The padded material is preferably highly elastic, to prevent a user from being hurt when the user falls on the padded material or is hit by the padded material.

The mat material is preferably at least 1, 2, or even 3 cm in thickness, and is preferably between 1-3 cm in thickness at its edges so as to be easily gripped and carried by a child. While the panels are preferably made from the same compressible materials, panels could be made from different materials without departing from the scope of the current invention.

While the play pieces could also mate with an edge of a panel, for example a recess or an interlocking structure, the play pieces preferably mate with the panels by being shaped and configured to fit within holes formed in the panel. While the holes could be shallow recesses, the holes are preferably "through holes" that run all the way through to the opposing side of the panel. The through hole could be angled or straight, and could be shaped to hold one or more play pieces in any suitable configuration. Each play piece could be made from the same color and material as the surrounding panel, or could be made from other colors or materials, depending on need.

Two or more of the play pieces could also be configured to mate angularly with one another. Like the panels, the play pieces could be configured to mate at any suitable angle, but are generally configured to mate at substantially 90 degree angles or substantially 180 degree angles. Preferably, the play pieces connect to one another to form a play figure, for example an animal, a vehicle, or an imaginative environment such as a beach or a castle. In an exemplary embodiment, play pieces could be recombined to form different play figures, for example a vehicle and an animal or two different vehicles.

In a preferred embodiment, animal play figures are contemplated to have reinforced bodies to add durability and stability. An exemplary method of reinforcing a body is to layer multiple body play pieces. In a preferred embodiment, multiple body pieces could be interlocked to form a single middle layer sandwiched in between two smaller body pieces that cover and reinforce at least part of the interlocking portions. The layered pieces could then be configured to mate with one or more leg pieces with a groove or other interlocking structure. Preferably, the leg pieces mate at substantially 90 degree angles with the layered body pieces to stabilize the body. Head pieces could then be coupled to a body piece, and/or foot pieces could be coupled to a leg piece, to complete the animal play figure.

In yet another preferred embodiment, environmental play figures are generally configured to mate angularly with one or more panels. For example, a substantially cylindrical shape could be placed within a substantially cylindrical hole in a panel to form the trunk of a tree. Play figures could also be configured to interlock with one another. For example, a skeleton play figure could be configured to interlock with a dungeon play figure, a cannon play figure could be configured to interlock with a castle play figure, or a monkey play figure could be configured to interlock with a tree play figure.

Preferably, at least one side of a panel or a play piece has a design that corresponds with a play figure. For example, a panel could have a print layer of brick walls with windows and doors to encourage a user to build a castle or a house with the mats. Or a play piece could have a print layer of trees and bushes to encourage a user to build a plant. It is contemplated that the mats have prints on both sides.

Various objects, features, aspects and advantages of the inventive subject matter will become more apparent from the following detailed description of preferred embodiments, along with the accompanying drawing figures in which like numerals represent like components.

BRIEF DESCRIPTION OF THE DRAWING

FIG. 1 is a plan view of a transformative floor mat that is configured to form a floor mat or an alligator play figure.

FIG. 2 is a perspective view of the alligator play figure constructed from the play pieces of FIG. 1.

FIG. 3 is a plan view of a transformative floor mat that is configured to form a floor mat or an elephant play figure.

FIG. 4 is a plan view of the elephant play figure's central body section constructed from the play pieces of FIG. 3.

FIG. 10 is a perspective view of the lion play figure of FIG. 9.

FIG. 12 is a plan view of a transformative floor mat that is configured to form a plurality of different car play figures.

DETAILED DESCRIPTION

Figure 5:
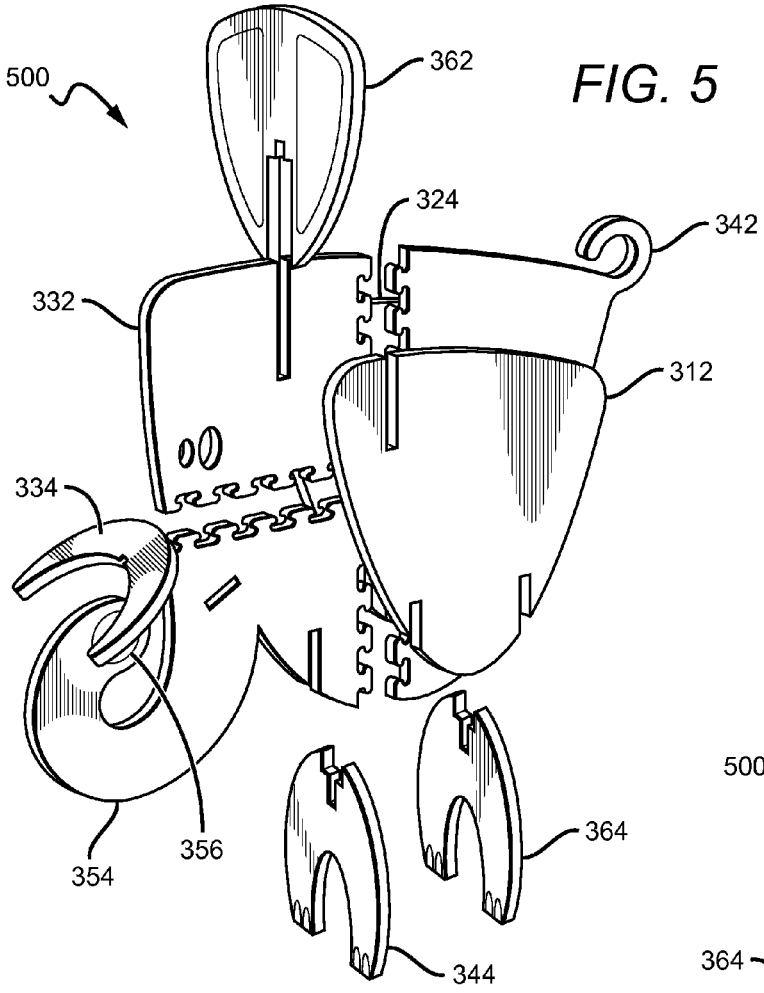
FIG. 5 is an exploded view of the elephant play figure constructed from the play pieces of FIG. 3.
Figure 7:
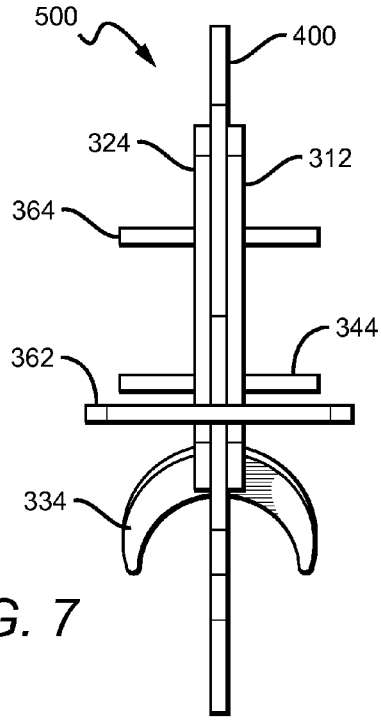
FIG. 7 is an alternative view of the elephant play figure of FIG. 6.
Figure 6:
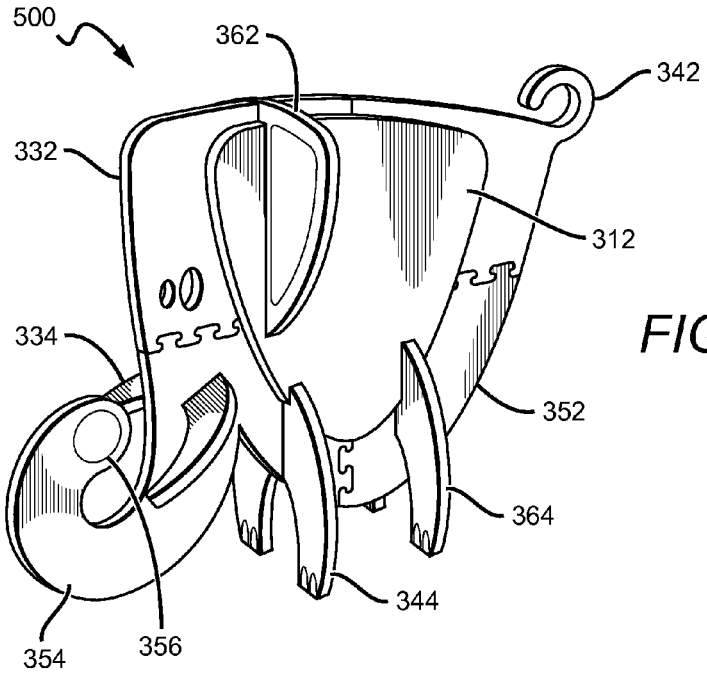
FIG. 6 is a perspective view of the elephant play figure of FIG. 5.
Figure 8:
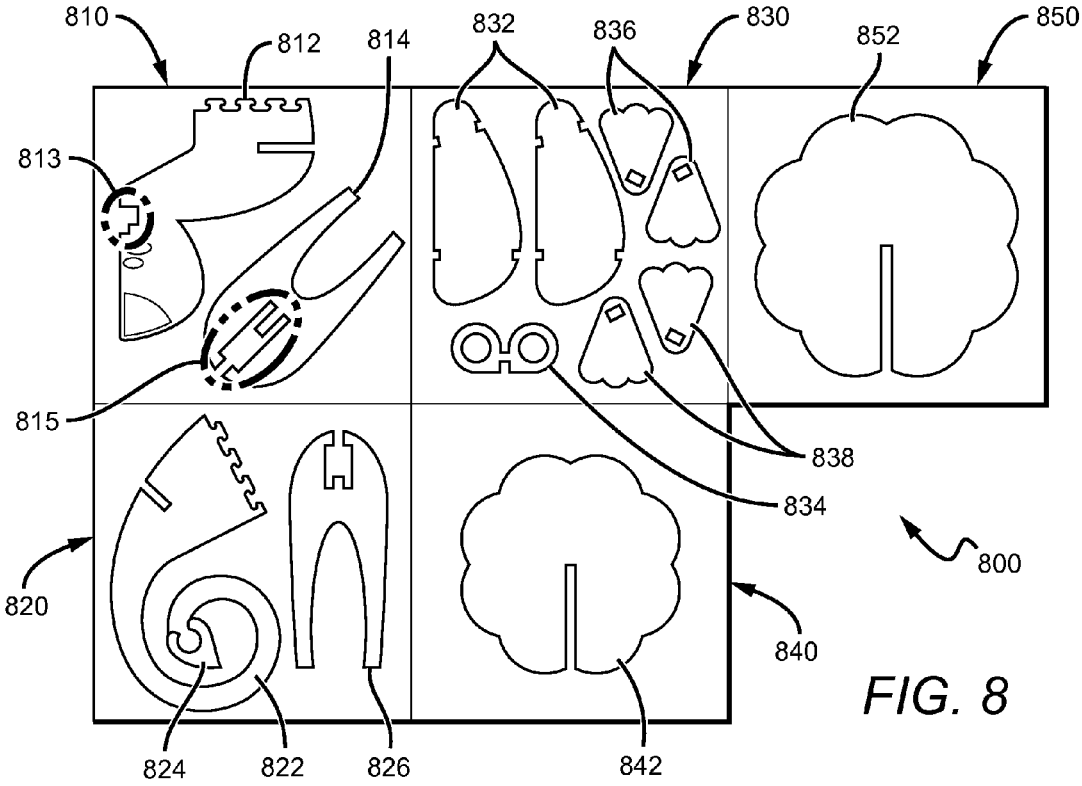
FIG. 8 is a plan view of a transformative floor mat that is configured to form a floor mat or a lion play figure.
Figure 9:
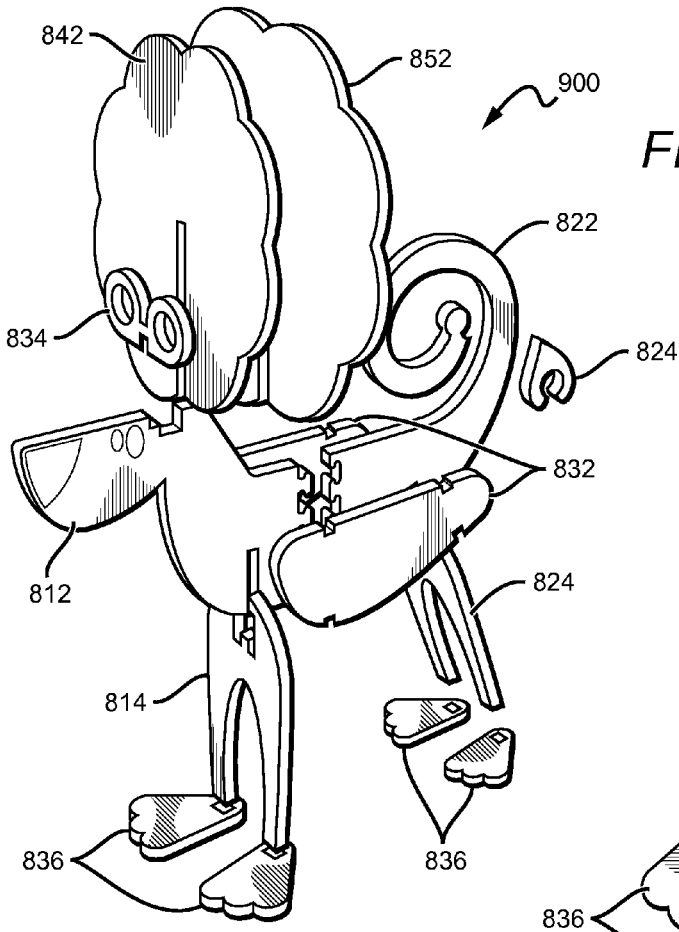
FIG. 9 is an exploded view of the lion play figure constructed from the play pieces o FIG. 8.
Figure 11:
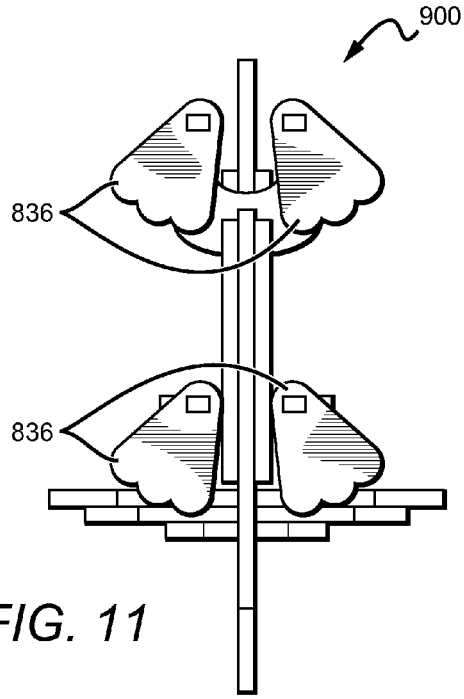
FIG. 11 is an alternative view of the lion play figure of FIG. 10.
Figure 13A:
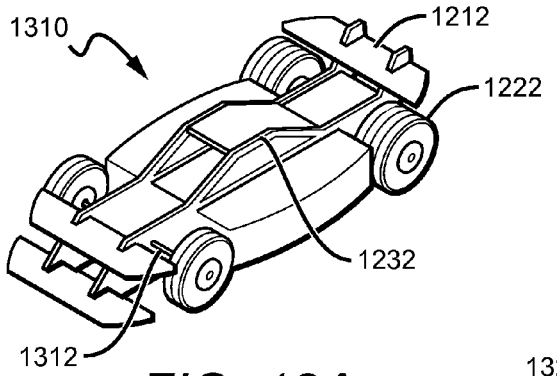
FIG. 13A-13D are perspective views of different car play figures that could be constructed from the play pieces of FIG. 12.
Figure 13B:
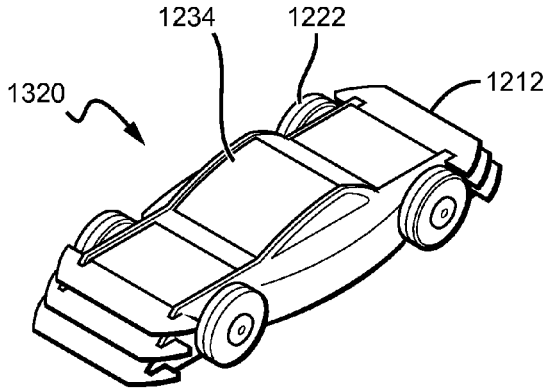
Figure 13C:
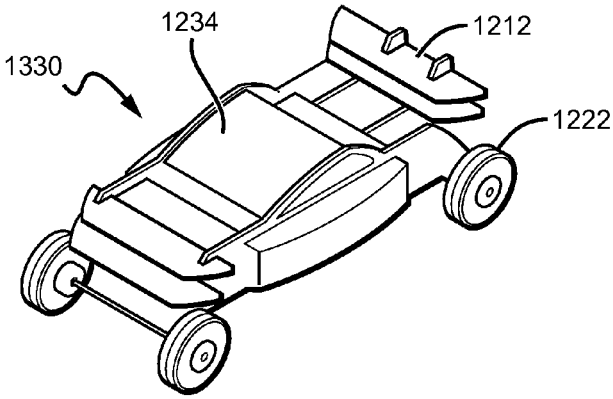
Figure 13D:
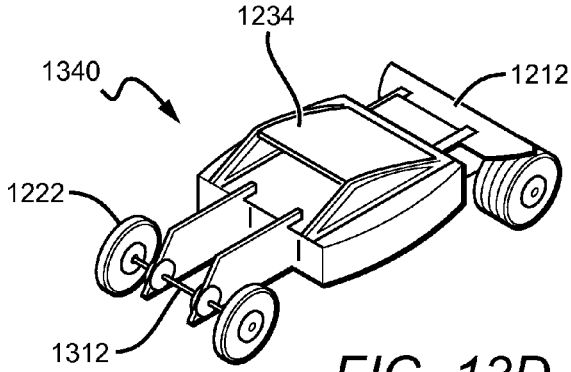

The present inventive subject matter provides for a transformative floor mat with interlocking panels and play pieces, which can be used to form floor mats, stacks of tiles, and play figures.

In FIG. 1, a transformative floor mat 100 generally comprises a first panel 110, a second panel 160, and various play pieces 170, 180, and 190.

First panel 110 is configured to mate planarly with second panel 160 via connecting edge 112 on first panel 110 and connecting edge 162 on second panel 160. Connecting edge 112 comprises a series of interlocking structures, trapezoidal recesses and 114 and trapezoidal projections 116, which match trapezoidal recesses 164 and trapezoidal projections 166 composing connecting edge 162. Trapezoidal projections 116 are preferably slightly rounded to minimize any sharp edges in transformative floor mat 100.

While connecting edge 112 is shaped to have trapezoidal projections and recesses, the connecting edge could be shaped in any suitable manner to interconnect the panels. Preferably, the projections and recesses are shaped with a wide tip and a narrow neck to prevent the panel from easily slipping out of the mating interlock. As shown, the entire perimeter of first panel 110 comprises interlocking structures, allowing first panel 110 to interlock with another panel in any direction. However, it is contemplated that a panel could be constructed with at least one edge without any interlocking structure.

First and second panels 110, 160 could be made from any suitable material or mixture of materials commonly known for floor covering, including rubber, foam, wood, or other elastic materials. In preferred embodiments, the panels are made from a co-polymeric foam, for example polyurethane. More preferably, the panels are made from ethylene vinyl acetate ("EVA"). The surface of panels is slightly corrugated to provide a textured surface that prevents a user from slipping on the panel when used as a floor mat, although flat surfaces and slightly curved surfaces are also contemplated.

Second panel 160 is constructed similarly to first panel 110, but second panel 160 also has play pieces 170, 180, and 190, which are all configured to mate planarly in matching through holes. While these play pieces are preferably created by "stamping" or otherwise cutting holes in second panel 160, play pieces 170, 180, and 190 could conceivably be molded separately from second panel 160. Play pieces 170, 180, and 190 could also be configured to mate planarly within non-penetrating holes in panel 160 to provide for thinner play pieces. The edges of the play pieces are preferably slightly corrugated to provide additional friction to hold the play pieces in place within second panel 160. Preferably the friction force between the play pieces and the panel is just enough such that a child could easily separate the play pieces from the panel.

Play pieces 170, 180, and 190 have interlocking edges 172, 182/184, and 192, respectively. These interlocking edges are configured to mate planarly with the holes formed in second panel 160 such that the play pieces mate with second panel 160 form a substantially contiguous plane. As shown in FIG. 2, these interlocking edges are also configured to mate angularly with one another to form alligator play FIG. 200. While the interlocking edges are configured to mate angularly at a substantially 90 degree angle, the interlocking edges could be configured to mate at different angles, or at a variety of angles, without departing from the scope of the invention.

Since the recess along interlocking edge 182 is configured to receive the width of body 170 and the recess along interlocking edge 192 is configured to receive the width of leg 180, it is preferred that the recesses along the interlocking edges are slightly smaller than the thickness of the play pieces. This allows a tighter fit between play pieces when they are connected, and assists in preventing a play figure from falling apart absent a significant force applied by a user.

FIGS. 3-7, FIGS. 8-11, FIGS. 12-15 show other preferred embodiments of transformative floor mats configured to interlock to form a variety of animal figures.

FIGS. 3-7 depict an alternative transformative floor mat 300 with panels 310, 320, 330, 340, 350, and 360. The edges of panels 310, 320, 330, 340, 350, and 360 are not configured to mate planarly with one another, and can therefore slide away from one another easily. Within the panels of floor mat 300 are collectively cut several play pieces—central body pieces 332, 342, 352, and 354, side body pieces 312 and 324, leg pieces 344 and 364, tusk piece 334, and head piece 362. The play pieces are all configured to form elephant play FIG. 500.

Central body piece 332 comprises eyes 333, which are preferably a different color than the rest of central body piece 332. This differential color shading could be achieved in any suitable manner, for example by dying the surface of the play piece an alternate color, or by providing punch-out eyes which could be replaced by play piece eyes of different colors. In this manner, a user could customize a color palate of elephant play FIG. 400 with separate and different color parts to replace the corresponding parts, such as eyes 333, inner ears 363, toenails 365, and nose 356.

As shown in FIG. 4, central body pieces 332, 342, 352, and 354 all have connecting edges with interlocking structure along a portion of their perimeter to form central body section 400. Central body section 400 is flanked on two opposing sides by side body pieces 312 and 324, which are all configured to be received by leg pieces 344 and 364. By flanking body pieces around the central body piece, the body of elephant play FIG. 500 is strengthened and stabilized. Elephant play FIG. 500 also comprises tusk piece 334, which angularly mates with recess 355. As shown, even curved play pieces could be configured to angularly mate with play pieces.

FIGS. 8-11 depict an alternative transformative floor mat 800 with panels 810, 820, 830, 840, and 850. The panels comprise central body pieces 812, 822, and 824, side body pieces 832, front leg 814, rear leg 826, front feet 836, rear feet 838, and head pieces 834, 842, and 852. The play pieces are all configured to form lion play FIG. 900.

As shown, front leg 814 and rear leg 826 are both configured to mate with side body pieces 832 at a substantially 90 degree angle from the bottom surface of the side body pieces. However, because side body piece 832 has a curved angle, front leg 824 and rear leg 826 are not parallel with one another. This allows lion play FIG. 900 to have an angled stance. Likewise, front feet 826 have recess holes that run straight up and down to match front leg 824, while rear feet 838 have recess holes that are angled, to accommodate angled rear leg 826.

Central body piece 812 has an open tiered recess 813 which allows the recess to receive head piece 834 on a separate level to head pieces 842 and 852. Open tiered recess 813 contrasts with closed tiered recess 815, which has a narrow opening that fans out to a wider opening, which then splits into two tips. Closed tiered recess 815 provides for a tighter fit when front leg 814 receives central body piece 812 and side body pieces 832. Closed tiered recesses are especially preferred for body pieces that could be roughly handled by a user.

FIG. 12 depicts an alternate transformative floor mat 1200 with panels 1210, 1220, 1230, 1240, 1250, and 1260. This transformative floor mat has a plurality of play pieces that are configured to form a plurality of different car play FIGS. 1310, 1320, 1330, and 1340, shown in FIGS. 13A-13D. Axle 1312 is a play piece that sits separate and apart from the panels, and is only used to help spin wheels 1222. Axle 1312 could be made from the same material as the play pieces, but is preferably made from wood or plastic to assist allowing the wheels to spin. While axle 1312 is not configured to mate planarly with transformative floor mat 1200, axle 1312 could be configured to mate with a recess in one or more of the panels of transformative floor mat 1200 without departing from the scope of the current invention.

As shown, the play pieces are configured to mate with one another in a variety of different ways. For example, car play FIG. 1310 has a different car cabin hood 1232 than the car cabin hood 1234 that car play FIG. 1320 uses, car play FIG. 1320 has attached spoiler wing 1212 in a different configuration than car play FIG. 1330, and car play FIG. 1330 has attached a different number of wheels 1222 to axle 1312 than car FIG. 1340. Other car configurations are possible than what is depicted in the drawings. One of skill in the art would be able to use transformative floor mat 1200 as a car building kit to build a plurality of other car play figures that look different from one another.

Figure 14:
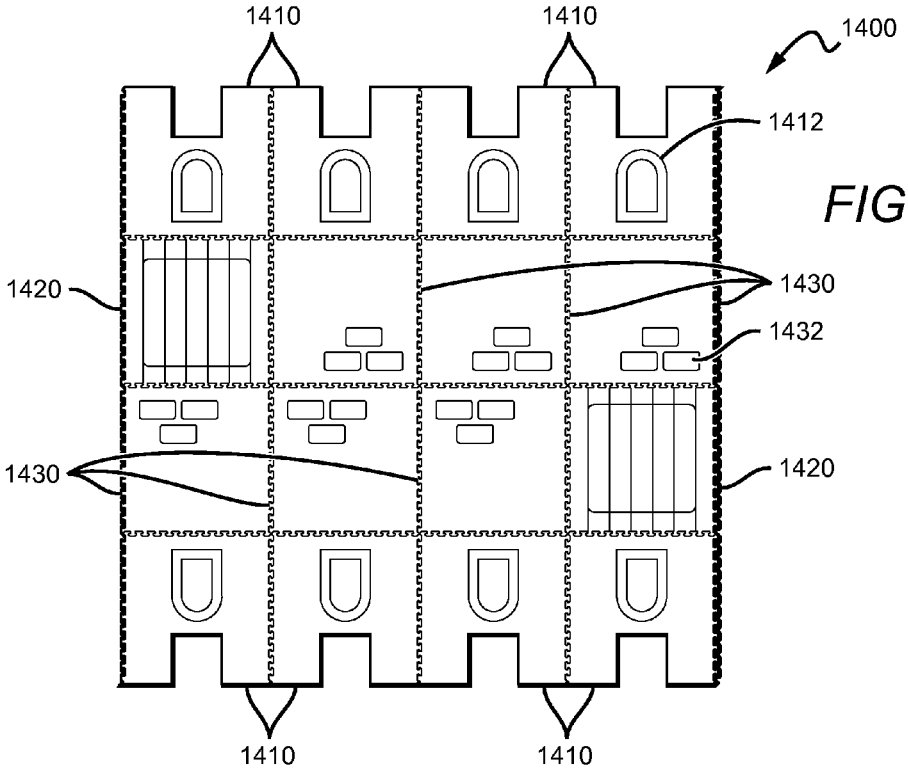
FIG. 14 is a plan view of a transformative floor mat that is configured to form a castle play figure.
Figure 15:
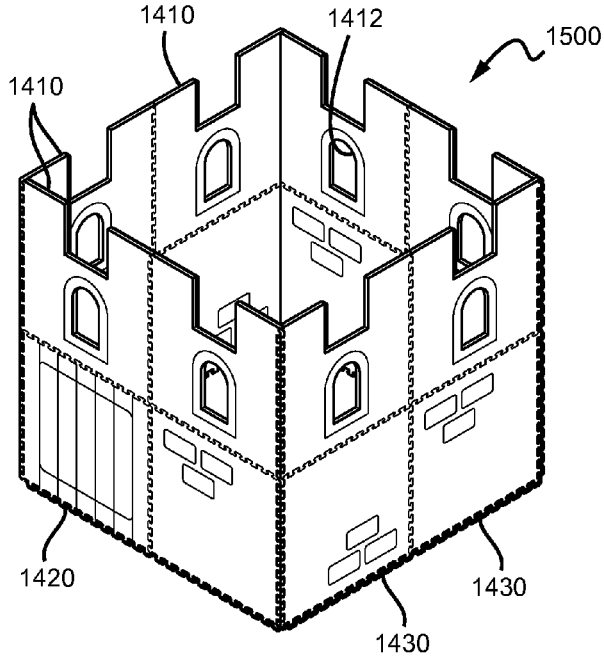
FIG. 15 is a perspective view of a castle constructed from the panels of FIG. 14.

FIGS. 14-15 depict a transformative floor mat 1400 with crenellation panels 1410, door panels 1420, and wall panels 1430 configured to create castle play FIG. 1500. Crenellation panels 1410 have three edges with interlocking structures and an upper edge without interlocking structure, while door panels 1420 and wall panels 1430 have interlocking structure composing their entire perimeters. Crenellation panels 1410 also have windows 1412 which could be popped out, or could be exchanged with other windows (not shown) to add different stained glass embodiments. Wall panels 1430 also have bricks 1432 that could be popped out during battle to create a look of a damaged castle, and could be used in other play figures as structural elements.

Figure 16:
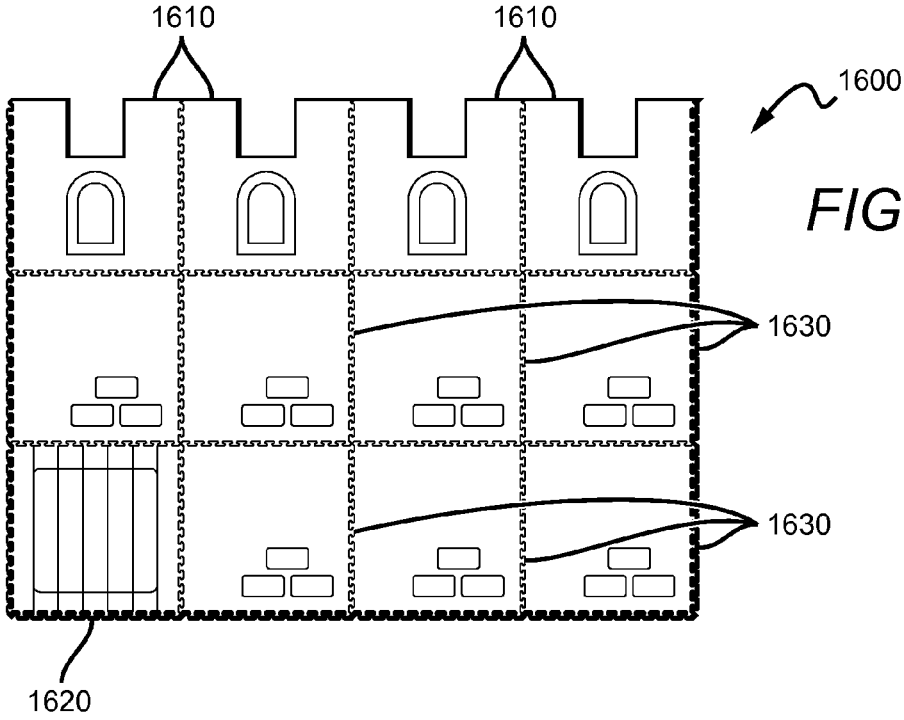
FIG. 16 is a plan view of a transformative floor mat that is configured to form a tower play figure.
Figure 17:
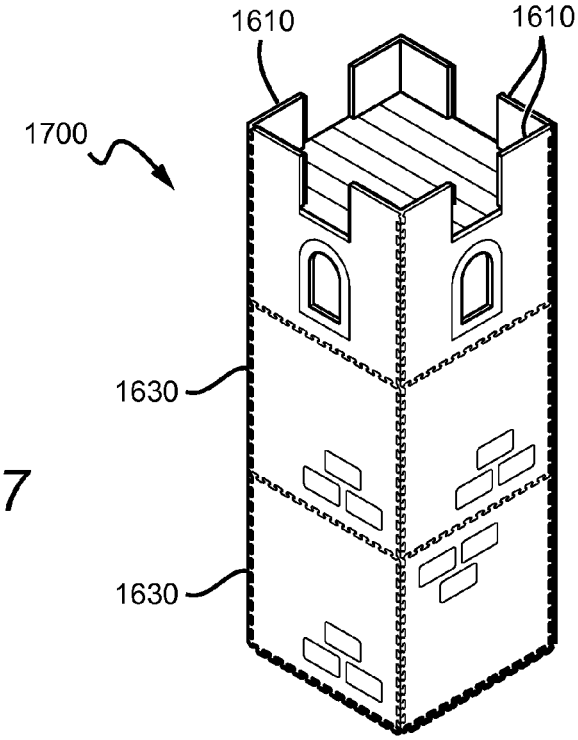
FIG. 17 is a perspective view of a tower constructed from the panels of FIG. 16.
Figure 18:
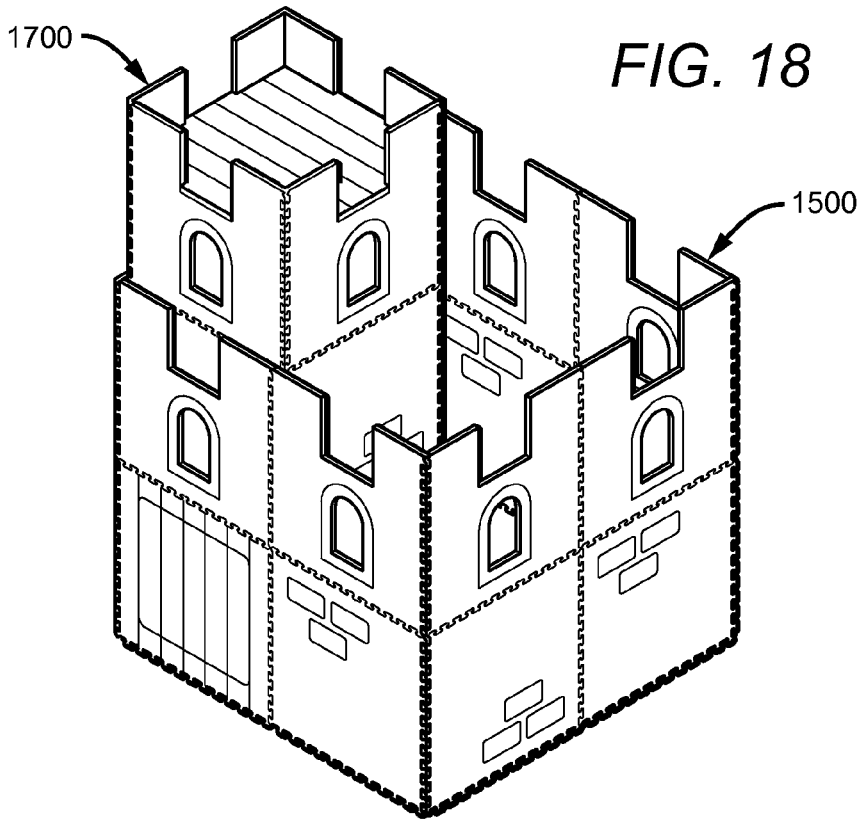
FIG. 18 is a perspective view of the castle of FIG. 15 juxtaposed with the tower of FIG. 17.

FIGS. 16-17 depict a transformative floor mat 1600 with crenellation panels 1610 door panel 1620, and wall panels 1630, configured to create tower play FIG. 1700. The panels of transformative floor mat 1600 are preferably shaped to have a length and width about 2-3 cm shorter than the panels of transformative floor mat 1400, to allow for tower play FIG. 1700 to optionally fit inside castle play FIG. 1500, as shown in FIG. 18. Tower play FIG. 1700 also has roof 1710 that fits within the upper recesses of crenellation panels 1610 to allow a user to place warrior figurines or other weaponry on top of roof 1710. Roof 1710 could have recesses (not shown) that could be configured to mate with play figure weaponry, such as cannon or trebuchet play figures.

Figure 19:
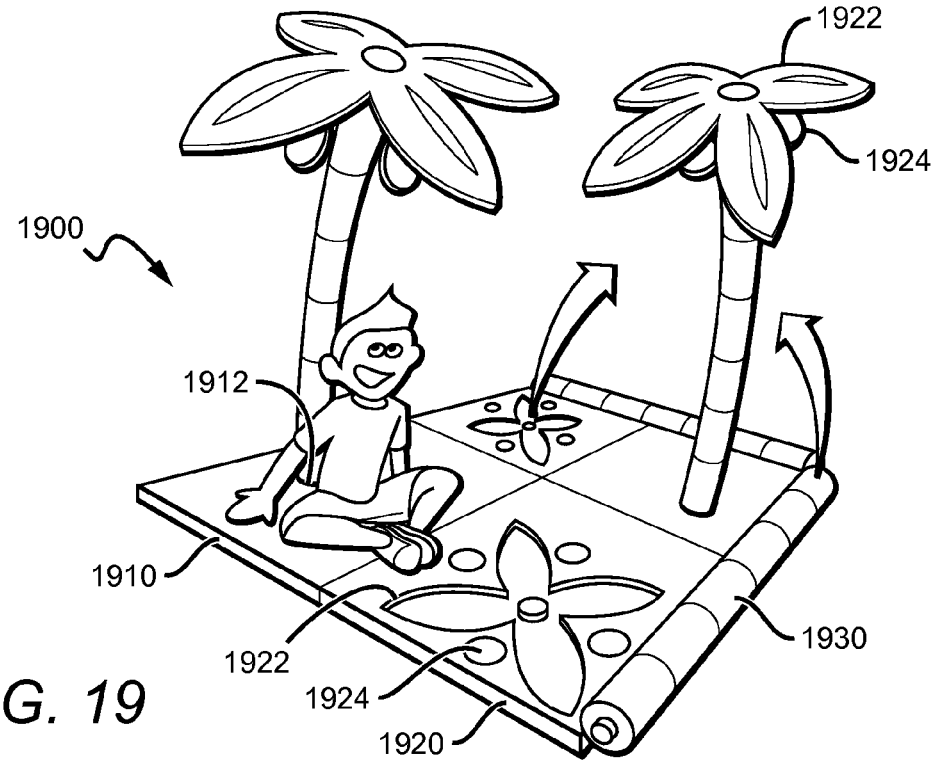
FIG. 19 is a perspective view of transformative floor mat that is configured to form trees.

FIG. 19 depicts another transformative floor mat 1900 with panels 1910 and 1920, which is configured to create tree play figures. Transformative floor mat 1900 also has attached play FIG. 1930 that mates with hole 1912 and with leaves 1922. Attached play FIG. 1930 serve to be additional pieces for a play figure. Preferably, the attached play figure can be connected to the edges of the floor mat via a recess (not shown) on the attached play figure to receive an edge of the floor mat. However, it is also contemplated that an attached play figure can be included as additional parts to the floor mat. Attached play figure does not necessarily have to connect with the floor mat. Various shapes and sizes of the attached play figure are contemplated to form various play figure. For example, attached play FIG. 1930 works with coconuts 1924 and leaves 1922 to allow for a tropical look.

In yet another preferred embodiment, a kit is sold containing a set of floor mats to form a particular figure and instructions to do so. It is also contemplated that multiple sets of floor mats are sold to form a large scale play figure, such as a castle.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A transformative floor mat, comprising:

a first panel and a second panel, wherein the first panel is configured to mate planarly with the second panel;

a first play piece that is configured to mate planarly with the first panel, wherein the first play piece comprises a first slot that mates with a first projection of the first panel; and a second play piece that is configured to mate planarly with at least one of the first and second panel, wherein the second play piece comprises a second slot that mates with a second projection of the second panel, wherein the second slot is configured to mutually accept the first slot to form a play figure.

2. The transformative floor mat of claim 1, wherein the first panel comprises a plurality of interlocking structures.

3. The transformative floor mat of claim 1, wherein the first panel is configured to mate angularly with the second panel.

4. The transformative floor mat of claim 1, wherein the first panel is configured to mate at a substantially 90 degree angle with the second panel.

5. The transformative floor mat of claim 1, wherein the first panel comprises a hole that is configured to mate planarly with the first play piece.

6. The transformative floor mat of claim 5, wherein the hole comprises a through hole in the first panel.

7. The transformative floor mat of claim 1, wherein the first play piece is configured to mate at a substantially 90 degree angle with the second play piece.

8. The transformative floor mat of claim 1, further comprising a third play piece configured to mate angularly with the second panel.

9. The transformative floor mat of claim 8, wherein the third play piece comprises a substantially cylindrical shape.

10. The transformative floor mat of claim 8, wherein the third play piece is configured to mate angularly with a hole in the second panel.

11. The transformative floor mat of claim 10, wherein the second play piece is configured to mate planarly with the hole in the second panel.

12. The transformative floor mat of claim 1, wherein the second panel further comprises a top side with a plurality of projections and an opposing bottom side with a plurality of recesses that match the plurality of projections.

13. The transformative floor mat of claim 1, wherein a length of the first panel is greater than 15 inches.

14. The transformative floor mat of claim 1, wherein a length of the first panel is greater than 25 inches.

15. A transformative floor mat, comprising:

a plurality of panels into which are collectively cut first, second, and third body pieces, and first and second leg pieces;

the first body piece has an edge that mates in an interlocking fashion with an edge of the second body piece;

the first leg piece has at least one slot that is configured to receives the first and third body pieces simultaneously, and is configured to mate with a first projection of the plurality of panels; and the second leg piece has at least one slot that receives the second and third body pieces simultaneously, and is configured to mate with a second projection of the plurality of panels.

16. The transformative floor mat of claim 15 further comprising a first head piece cut from one of the plurality of panels that mates with a recess of the first body piece.

17. The transformative floor mat of claim 16, further comprising a second head piece cut from one of the plurality of panels that also mates with the recess of the first body piece.

18. The transformative floor mat of claim 15 further comprising a foot piece cut from one of the plurality of panels that mates with the first leg piece.

19. The transformative floor mat of claim 15, further comprising a fourth body piece, wherein the at least one slot that receives the first and third body pieces simultaneously also receives the fourth body piece at the same time.

20. The transformative floor mat of claim 15, wherein the first, second, and third body pieces, and first and second leg pieces compose three different panels.

* * * * *